United States Patent [19]

Tomita

[11] 4,205,255

[45] May 27, 1980

[54] COLOR CATHODE RAY TUBE WITH REFLECTIVE LAYERS HAVING APICES CENTERED BETWEEN MATRIX WINDOWS

[75] Inventor: Yoshifumi Tomita, Mobara, Japan

[73] Assignee: Hitachi Ltd., Tokyo, Japan

[21] Appl. No.: 918,839

[22] Filed: Jun. 26, 1978

[30] Foreign Application Priority Data

Jun. 29, 1977 [JP] Japan ..... 52-76509

[51] Int. Cl.[2] ..... H01J 29/28; H01J 29/30; H01J 29/32

[52] U.S. Cl. ..... 313/470; 313/472

[58] Field of Search ..... 313/472, 470

[56] References Cited

U.S. PATENT DOCUMENTS

| | | | |
|---|---|---|---|
| 3,614,503 | 10/1971 | Dietch | 313/472 |
| 3,761,756 | 9/1973 | Miura et al. | 313/470 |
| 3,952,225 | 4/1976 | Dietch | 313/472 |
| 4,082,978 | 4/1978 | Schwarz | 313/472 |

FOREIGN PATENT DOCUMENTS 53-3054 of 1978 Japan .

*Primary Examiner*—Robert Segal
*Attorney, Agent, or Firm*—Charles E. Pfund

[57] ABSTRACT

A fluorescent screen formed on the inner surface of the face plate of a color picture tube comprises a plurality of spaced apart light absorbing layers between adjacent matrix windows, light reflection layers formed on the light absorbing layers, stripe shaped three color phosphors respectively formed between adjacent light reflection layers to fill the matrix windows, and a metal back layer covering the light reflection layers and the three color phosphors. Each light reflection layer takes the form of a triangular section having a height substantially equal to the thickness of the three color phosphors and the opposite sides of the triangle incline toward the sides of the matrix windows. The width of each window is equal to the difference between a maximum electron beam diameter and one half the difference between the pitch of the windows and the width of each window.

4 Claims, 5 Drawing Figures

COLOR CATHODE RAY TUBE WITH REFLECTIVE LAYERS HAVING APICES CENTERED BETWEEN MATRIX WINDOWS

BACKGROUND OF THE INVENTION

This invention relates to a black matrix type color picture tube capable of improving brightness and contrast without impairing beam landing tolerance.

A color picture tube generally comprises an envelope made up of a cylindrical neck, a funnel with its small diameter side connected to the neck, and a face plate sealed to the large diameter side of the funnel. An electron gun assembly of three electron guns is contained in the neck and a fluorescent screen is coated on the inner surface of the face plate. Confronting the rear side of the fluorescent screen is disposed a color selection electrode in the form of a shadow mask, for example. The electron beams emitted from respective electron guns transmit through apertures of the color selection electrode and then impinge upon the fluorescent screen to generate three colors.

The fluorescent screen of a color picture tube comprises stripes or dots in which phosphors that luminesce three primary colors, that is, green, blue and red, are arranged with light absorbing layers interposed therebetween. In the following, a stripe type fluorescent screen will be described but it should be understood that a similar description applies also to a dot tube.

FIG. 1 is a sectional view showing one example of the fluorescent screen of a prior art color picture tube. A plurality of stripe films 1*b* of such light absorbing material as graphite are formed on the inner surface of a face plate 1*a* with a suitable spacing between adjacent films 1*b* to act as the light absorbing layers. Three color phosphor stripes 1*c* (green), 1*d* (blue) and 1*e* (red) are formed on the stripe films 1*b* to respectively bridge adjacent stripe films and fill the space therebetween. An aluminum film 1*f* is applied on the phosphor stripes to act as a light reflecting metal back layer. The fluorescent screen having this construction is the so-called negative guard band type matrix fluorescent screen, and the gaps between the light absorbing layers 1*b* are termed matrix windows (in the case of the dot type fluorescent screen, matrix openings). As the gaps are increased, the amount of light emitted by the phosphors and derived out to the front side of the fluorescent screen increases, thereby increasing the brightness thereof. However, as the gap is increased, the difference between the diameter of the electron beam and the gap width decreases with the result that the tolerance of the beam landing decreases. Consequently, there are caused such problems of beam landing as clipping tolerance (the beam of one color collides upon the phosphor of other colors) and leaving tolerance (a beam partially leaves a given phosphor to be luminesced thereby). Moreover, since phosphors of respective colors are in the form of white powders having a percentage of reflection of about 85%, as the width of the window increases, the body color of the fluorescent screen approaches white, thereby impairing the appearance. On the contrary, when the width of the window decreases, the picture becomes dark, thus decreasing the commercial value.

SUMMARY OF THE INVENTION

Accordingly, it is an object of this invention to provide an improved black matrix type color picture tube which can greatly improve the contrast of the picture image without decreasing the brightness while maintaining a sufficiently large beam landing tolerance.

According to this invention, there is provided a black matrix type color picture tube comprising an envelope including a cylindrical neck, a funnel with its small diameter end connected to the neck, and a face plate sealed to the large diameter end of the funnel, a fluorescent screen formed on the inner surface of the face plate, said fluorescent screen including three color stripe shaped phosphors which are arranged on the fluorescent screen through light absorbing layers, an electron gun assembly contained in the neck and including three electron guns for emitting three electron beams, and a color selection electrode disposed on the rear side of the fluorescent screen and including apertures for passing the electron beams and causing them to impinge upon the fluorescent screen so as to form a picture image, wherein the fluorescent screen comprises a plurality of spaced apart light absorbing layers respectively formed between adjacent matrix windows provided for the fluorescent screen, light reflection layers formed on the light absorbing layers on the side thereof facing the electron gun assembly, stripe shaped three color phosphors respectively formed between adjacent light reflection layers to fill the matrix windows, and a metal back layer covering the light reflection layers and the three color phosphors on the side thereof facing the electron gun assembly, each one of the light reflection layers having an apex at the center between the centers of adjacent windows, the height of the apex being substantially equal to the thickness of the phosphors, the height of each light reflection layer decreasing gradually toward the sides of the windows, and each window having a width equal to the difference between a maximum electron beam diameter and one half the difference between the pitch of the windows and the width of each window.

According to another aspect of this invention, there is provided a black matrix type color picture tube comprising an envelope including a cylindrical neck, a funnel with its small diameter end connected to the neck, and a face plate sealed to the large diameter end of the funnel, a fluorescent screen formed on the inner surface of the face plate, the fluorescent screen including three color dots which are arranged on the fluorescent screen through light absorbing layers, an electron gun assembly contained in the neck and including three electron guns for emitting three electron beams, and a color selection electrode disposed on the rear side of the fluorescent screen and including apertures for passing the electron beams and causing them to impinge upon the fluorescent screen so as to form a picture image, wherein the fluorescent screen comprises a plurality of spaced apart light absorbing layers respectively formed between adjacent matrix openings provided for the fluorescent screen, light reflection layers formed on respective light absorbing layers on the side thereof facing the electron gun assembly, dot shaped three color phosphors respectively formed between adjacent light reflection layers to fill the matrix openings, and a metal back layer covering the light reflection layers and the three color phosphors on the side thereof facing the electron gun assembly, each one of the light reflection layers having an apex at the center between the centers of adjacent matrix openings, the height of the apex being substantially equal to the height of the phosphors, the height of each light reflection layer decreasing gradually toward the peripheries of the matrix openings, and each matrix opening having a diameter equal to the difference between a maximum electron beam diameter and one half the difference between the pitch of the matrix openings and the diameter of the matrix openings.

BRIEF DESCRIPTION OF THE DRAWING

Further objects and advantages of the invention can be more fully understood from the following detailed description taken in conjunction with the accompanying drawings in which.

DESCRIPTION OF THE PREFERRED EMBODIMENTS

Figure 1:
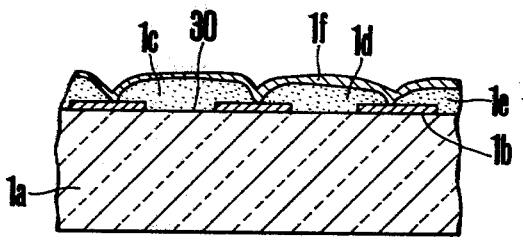
FIG.1 (PRIOR ART)
FIG. 1 is a sectional view of the fluorescent screen of a prior art color picture tube.
Figure 2:
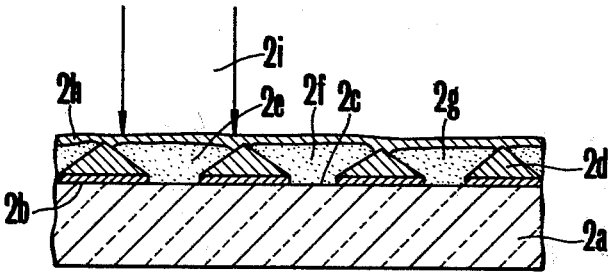
FIG. 2 is a sectional view showing a fluorescent screen embodying the invention.

FIG. 2 shows one embodiment of a fluorescent screen of this invention. Since a color picture tube to which the fluorescent screen of this invention is to be incorporated is well known in the art, such tube is not shown. The fluorescent screen shown in FIG. 2 comprises a face plate *2a*, stripe shaped light absorbing layers *2b*, matrix windows *2c* and light reflecting layers *2d* formed on respective light absorbing layers *2b* and made of laminations of layers of light reflective material, for examples layers of $TiO_2$. The cross-sectional configuration of each light reflection layer is triangular having an apex at the center between the centers of adjacent matrix windows and lower side edges near both sides of the matrix window. The height of the triangle is about 25μ. The light reflection layers are formed by a method described later. In the spaces between the light reflection layers *2d* are formed phosphor stripes *2e*, *2f* and *2g* which emits green, blue and red colors respectively and an aluminum layer *2h* having a thickness of about 2000 to 2500 Å is formed on the phosphor stripes to act as a metal back layer. As shown, the apex of each light reflection layer *2d* has a height substantially equal to the thickness of the phosphor stripes. When the phosphor stripes having a width larger than the width of the matrix window are excited by electron beams *2i* for different colors having diameters not to interfere with each other, the lights generated by such excitation are reflected many times by the light reflecting layers *2d* and the metal back layer *2h* and at last nearly all lights will emit to the outside through the matrix windows, thereby greatly improving the brightness of the fluorescent screen. In other words, it is possible to decrease the width of the matrix windows *2c* by an amount corresponding to the increase in the brightness, thus increasing the area of the light absorbing layers *2b* so as to improve the contrast. Further it is possible to decrease the diameter of the electron beam thus assuring required beam landing tolerance.

As described above, according to this invention, the portions of the phosphor stripes corresponding to the diameter of the electron beams which is larger than the width of the matrix windows are excited by the electron beams and the resulting lights are reflected many times by the light reflection layers *2d* and the metal back layer *2h* so that almost all lights are derived out to the outside through the matrix windows (in the case of dots, the openings), thus preventing loss of light and assuring required beam landing tolerance.

The concept of forming light reflection layers on the light absorbing layers has been disclosed in U.S. Pat. No. 3,614,503. In this patent, however, nothing is mentioned about the configuration of the light reflection layers on the light absorbing layers, nor the beam diameter, matrix opening diameter and the phosphor dot diameter. For example, when the phosphor dot diameter is equal to the matrix opening diameter, it is impossible for this patent to derive out to the outside, without loss, the light emitted from the excited phosphors having an area larger than that of the matrix opening. Lack of the consideration regarding relative dimensions of the electron beam diameter, the phosphor dot diameter and the matrix opening diameter shows that the inventor of this patent did not consider the beam landing tolerance. Color picture tubes having a small beam landing tolerance has low commercial value. More particularly, with a construction wherein the phosphor dot having a diameter larger than the diameter of a matrix opening is excited by an electron beam having a diameter larger than that of the matrix opening and the resulting light is derived out to the outside through the matrix opening, even when the matrix opening diameter is decreased so as to increase the so-called leaving tolerance (LT), the clipping tolerance (CT) would be decreased since with regard to the clipping tolerance, the limit of the electron beam diameter is equal to the diameter of a contact circle having its center at the center of the opening for each color, said diameter being equal to the distance between the centers of two adjacent matrix openings. This can be readily understood from the fact that, in a conventional fluorescent screen, the limit of the beam diameter with regard to the clipping tolerance was equal to the diameter of a contact circle having its center at the center of a matrix opening. This diameter equals the center-to-center distance between the adjacent matrix openings. According to this invention, for the purpose of eliminating the prior art defects the clipping tolerance is increased by decreasing the electron beam diameter to an extent in which at least the same brightness as that of the prior art can be obtained while reducing the matrix opening diameter. To this end, the aperture diameter of the shadow mask is more reduced than the prior art construction.

Figure 3:
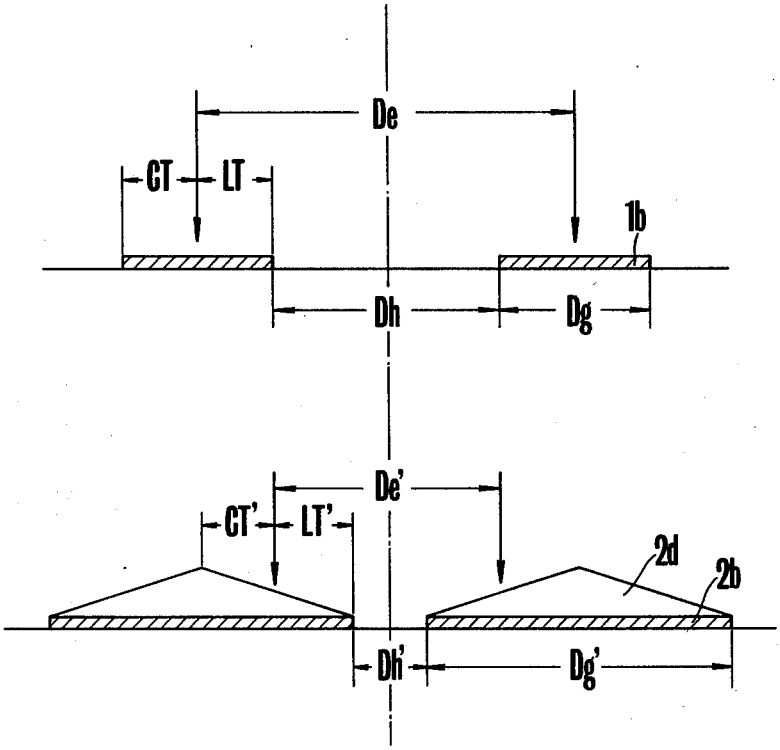
FIG. 3 is a diagram showing the relationship between the electron beam diameter and the gap diameter of the prior art color picture tube and the color picture tube embodying the invention.

This will be discussed in detail with reference to FIG. 3. Let us consider the beam landing tolerance of a stripe type fluorescent screen of a negative guard band type black matrix tube, and let us denote the electron beam diameter by De, the width of the matrix window by Dh, and the width of the light absorbing layer by Dg. Then, in a prior art color picture tube, the following equations hold:

$$CT=\tfrac{1}{2}(2Dg+Dh-De)$$

$$LT=\tfrac{1}{2}(De-Dh).$$

Since the landing tolerance is determined by either one of these two values which is smaller than the other, best result is obtained when the two values are equal. Thus, $$\tfrac{1}{2}(2Dg+Dh-De)=\tfrac{1}{2}(De-Dh),$$

$$De=Dg+Dh \text{ and } CT=LT=\tfrac{1}{2}Dg.$$

The sum Dg+Dh is equal to the distance (pitch) between the centers of adjacent windows so that with the electron beam diameter described above, adjacent electron beams contact with each other. In the case of the color picture tube of this invention, the following equations hold in which all symbols are primed:

$$CT'=\tfrac{1}{2}(Dg'+Dh'-De')$$

$$LT'=\tfrac{1}{2}(De'-Dh').$$

If $CT'=LT'$, then $De'=Dh'+\tfrac{1}{2}Dg'$ and $CT'=LT'=\tfrac{1}{4}Dg'$. Accordingly where $Dg'=2Dg$, the beam landing tolerance of the color picture tube of this invention becomes equal to that of the prior art tube. However, since $Dg+Dh=Dg'+Dh'=A-$(fluorescent screen pitch)$\times\tfrac{1}{3}$, that is, being equal to the distance (which is constant) between the centers of two adjacent matrix windows (openings), $$De'=Dh'+\tfrac{1}{2}De'=A-\tfrac{1}{2}Dg'=A-\tfrac{1}{2}(A-Dh').$$

More particularly, in the color picture tube of this invention, if the electron beam diameter De' were made equal to the difference between the distance between the center of adjacent matrix windows and $\tfrac{1}{2}\times$(said difference—the width of the matrix window), then CT'=LT', thereby assuring best condition of the beam landing. Furthermore, a relation $$De'=A-\tfrac{1}{2}Dg'=A-Dg=Dh$$

would be obtained. Thus, in the color picture tube of this invention, if the electron beam diameter De' were made equal to the width Dh of the window of the prior art tube, the construction of the fluorescent screen would be improved to provide a comparable brightness as that of the prior art tube. Consequently, it becomes possible to use a shadow mask having smaller apertures than the prior art so that the heat conductivity of the shadow mask increases, thereby eliminating unwanted variation in the beam landing caused by the thermal deformation of the shadow mask due to the electron beam, that is, by the so-called doming. The triangular configuration of the light reflecting layers of this invention greatly improves the utilization efficiency of the light emitted by the phosphors.

Table 1 below compares a prior art color picture tube incorporated with a gray panel with a color picture tube of this invention operating under a condition under which substantially the same percentage of reflection of the fluorescent screen is obtained even with a clear panel. In both tubes, stripe type fluorescent screens were used. By comparison, it will be noted that other design data can be used according to this invention.

Table 1

| Item | prior art tube | tube of this invention | remarks |
|---|---|---|---|
| shadow mask slot width | 215μ | 160μ | |
| electron beam diameter | 245μ | 190μ | |
| mask window width | 175μ | 100μ | |
| panel glass | gray | clear | |

Table 1-continued

| Item | prior art tube | tube of this invention | remarks |
|---|---|---|---|
| | (T = 0.65) | (T = 0.85) | |
| LT(leaving tolerance) | 35μ | 45μ | uniformity in white color |
| CT(clipping tolerance) | 57μ | 38μ | monochromatic purity |
| brightness | 100 | 130[100] | |
| percentage of reflection of fluorescent screen | 100 | 98[57] | |
| contrast | 100 | 129[160] | ambient: 500 lx light output: 1000 lx |
| mask doming | large | small | |

Remarks: data in [] are relative values when the prior art tube is provided with a clear panel.

Although the prior art tube uses a gray panel having a low percentage of transmission (T=0.65) for the purpose of improving contrast, the tube of this invention uses a clear panel (percentage of transmission T=0.85) so that the percentages of reflection of the fluorescent screens are comparable and in addition, the brightness increases by about 30% due to the difference in the percentages of transmission of the panel glasses. Consequently, the contrast has increased by 29%. As described above, since the beam landing tolerance is determined by one of LT and CT which is smaller than the other, the value of CT of 38μ of the tube of this invention is slightly larger than the value of LT of 35μ of the prior art tube. If the beam diameter is not limited even when LT increases, CT becomes 11μ so that the tolerance would be decreased. When a clear panel is used for the prior art tube, the contrast of the tube of this invention would be improved by about 60% assuring the same brightness. Anyhow, according to this invention, it is possible to greatly improve the brightness and contrast without impairing the beam landing tolerance.

One example of the method of manufacturing the fluorescent screen of this invention will now be described. At first, a panel is formed with black matrix windows or matrix openings by a conventional method. Then a coating liquid having the following composition is uniformly applied to the inner surface of the face plate to a thickness of about 30μ by rotating the face plate and is dried.

$TiO_2$: 40 weight % (fine powder of white pigment);
Az111: 10 weight % (positive type photoresist);
thinner: 50 weight %.

The coated composition is then exposed to ultraviolet light projected from the outside of the face plate. The exposed coating is then developed by a developer suitable for Az 111 to disolve exposed portions of the coating thus leaving laminations of $TiO_2$ having a desired configuration. Such a configuration as shown in FIG. 2 at *2d* can be formed because the light incident to the face plate is scattered by the particles of $TiO_2$, reaching the rear side of the light absorbing layer. Thus, the inclined side surface is not always plain although so illustrated in FIGS. 2, 3 and 4 for simplicity of illustration. Then, three color phosphors are applied by a conventional method. After filming, a metal back is formed to complete the fluorescent screen. Thereafter, the color picture tube is completed by well known steps.

Figure 4:
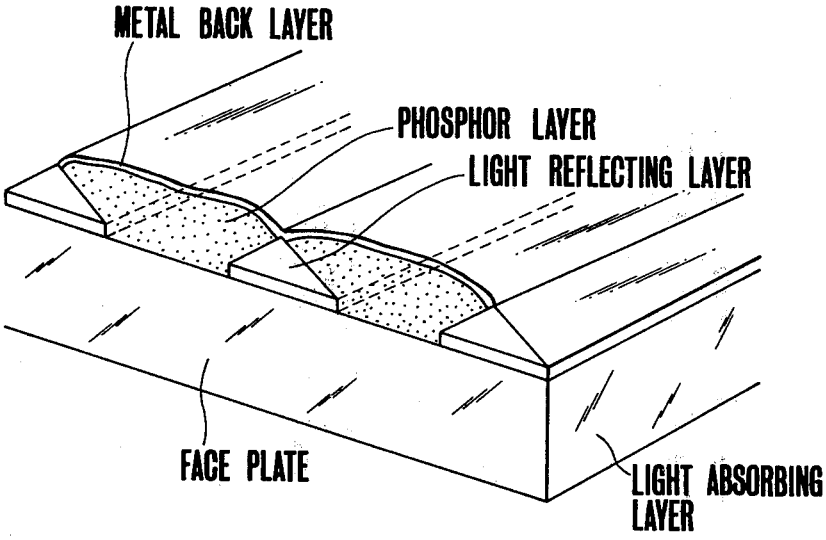
FIG. 4 is a perspective view of a fluorescent screen utilizing the stripe phosphors embodying the invention.
Figure 5:
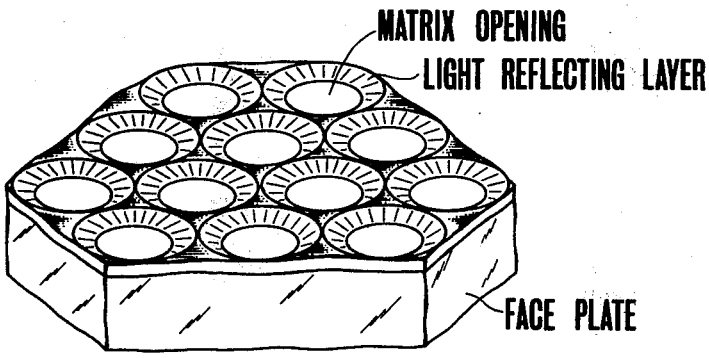
FIG. 5 is a perspective view of a fluorescent screen utilizing dot phosphors embodying the invention.

FIG. 4 is a perspective view of a stripe type fluorescent screen embodying the invention showing the detail of the construction thereof. While the foregoing description mainly relates to the use of stripe type phosphors, it will be clear that the invention is also applicable to fluorescent screens utilizing dot shaped phosphors, as shown in FIG. 5. The matrix windows of the stripe shaped fluorescent screen correspond to the matrix openings of the dot type fluorescent screen.

As described above, the invention can provide a guard band type black matrix color picture tube capable of improving the brightness and contrast without impairing the beam landing tolerance.

What is claimed is:

1. In a black matrix type color picture tube comprising an envelope including a cylindrical neck, a funnel with its small diameter end connected to said neck, and a face plate sealed to the large diameter end of said funnel, a fluorescent screen formed on the inner surface of said face plate, said fluorescent screen including three color stripe shaped phosphors which are arranged on said fluorescent screen through light absorbing layers, an electron gun assembly contained in said neck and including three electron guns for emitting three electron beams, and a color selection electrode disposed on the rear side of said fluorescent screen and including apertures for passing said electron beams and causing them to impinge upon said fluorescent screen so as to form a picture image, the improvement wherein said fluorescent screen comprises a plurality of spaced apart light absorbing layers respectively formed between adjacent matrix windows provided for said fluorescent screen, light reflection layers formed on said light absorbing layers on the side thereof facing said electron gun assembly, stripe shaped three color phosphors respectively formed between adjacent light reflection layers to fill said matrix windows, and a metal back layer covering said light reflection layers and said three color phosphors on the side thereof facing said electron gun assembly, each one of said light reflection layers having an apex at the center between the centers of adjacent windows, the height of said apex being substantially equal to the thickness of said phosphors, the height of each light reflection layer decreasing gradually toward the sides of said windows, and each window having a width equal to the difference between maximum electron beam diameter and one half the difference between the pitch of said windows and the width of each window.

2. In a black matrix type color picture tube comprising an envelope including a cyindrical neck, a funnel with its small diameter end connected to said neck, and a face plate sealed to the large diameter end of said funnel, a fluorescent screen formed on the inner surface of said face plate, said fluorescent screen including three color dots which are arranged on said fluorescent screen through light absorbing layers, an electron gun assembly contained in said neck and including three electron guns for emitting three electron beams, and a color selection electrode disposed on the rear side of said fluorescent screen and including apertures for passing said electron beams and causing them to impinge upon said fluorescent screen so as to form a picture image, the improvement wherein said fluorescent screen comprises a plurality of spaced apart light absorbing layers respectively formed between adjacent matrix openings provided for the fluorescent screen, light reflection layers formed on respective light absorbing layers on the side thereof facing said electron gun assembly, dot shaped three color phosphors respectively formed between adjacent light reflection layers to fill said matrix openings, and a metal back layer covering said light reflection layers and said three color phosphors on the side thereof facing said electron gun assembly, each one of said light reflection layers having an apex at the center between the centers of adjacent matrix openings, the height of said apex being substantially equal to the height of said phosphors, the height of each light reflection layer decreasing gradually toward the peripheries of the matrix openings, and each matrix opening having a diameter equal to the difference between a maximum electron beam diameter and one half the difference between the pitch of said matrix openings and the diameter of said matrix openings.

3. The black matrix type color picture tube according to claim 1 or 2 wherein each of said light reflection layers has a triangular cross-sectional configuration.

4. The black matrix type color picture tube according to claim 1 or 2 wherein each of said light reflection layer comprises $TiO_2$.

* * * * *

UNITED STATES PATENT AND TRADEMARK OFFICE

CERTIFICATE OF CORRECTION

PATENT NO. : 4,205,255

DATED : May 27,1980

INVENTOR(S) : Yoshifumi Tomita

It is certified that error appears in the above-identified patent and that said Letters Patent are hereby corrected as shown below:

Col. 1, line 29, change "tube" to -- type -- ;

Col. 1, line 42, insert -- black -- between "type" and "matrix" ;

Col. 5, line 15, change "CT" to -- CT' -- ;

Col. 5, line 17, change "LT" to -- LT' -- ;

Col. 5, line 18, change "CT=LT" to -- CT' = LT' -- ;

Col. 5, line 19, change "CT = LT" to -- CT' = LT' -- ;

Col. 8, line 6, change "cyindrical" to -- cylindrical --;

Signed and Sealed this

*Twenty-third* Day of *September 1980*

[SEAL]

*Attest:*

SIDNEY A. DIAMOND

*Attesting Officer*

*Commissioner of Patents and Trademark*